US006783005B2

(12) United States Patent
Giblin et al.

(10) Patent No.: US 6,783,005 B2
(45) Date of Patent: Aug. 31, 2004

(54) LINER

(75) Inventors: Edward John Giblin, Hopatcong, NJ (US); Corinne Saso, Ridgefield Park, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/749,971

(22) Filed: Dec. 28, 2000

(65) Prior Publication Data

US 2002/0088734 A1 Jul. 11, 2002

(51) Int. Cl.[7] ..... B65D 71/08

(52) U.S. Cl. ..... 206/497; 206/499; 206/526; 229/87.02

(58) Field of Search ..... 206/497, 499, 206/583, 503, 526, 427, 434; 229/87.01, 87.02, 933, 935, 936, 937, 103.2

(56) References Cited

U.S. PATENT DOCUMENTS

| | | | | | |
|---|---|---|---|---|---|
| 2,707,553 | A | | 5/1955 | Yount | |
| 2,762,550 | A | | 9/1956 | Goettsch et al. | |
| 2,987,176 | A | * | 6/1961 | Ringler | 229/936 |
| 3,371,815 | A | | 3/1968 | Macomber | |
| 3,401,814 | A | | 9/1968 | Chiswell et al. | |
| 3,804,235 | A | | 4/1974 | Anderson | |
| 3,918,584 | A | | 11/1975 | Richardson | |
| 3,995,736 | A | | 12/1976 | Lawson et al. | |
| 4,030,600 | A | | 6/1977 | Heaps | |
| 4,119,202 | A | | 10/1978 | Roth | |
| 4,177,895 | A | | 12/1979 | Shelton | |
| 4,306,653 | A | | 12/1981 | Fales | |
| 4,427,108 | A | * | 1/1984 | Coles et al. | 206/497 |
| 4,730,730 | A | | 3/1988 | Clarkson | |
| 4,738,371 | A | | 4/1988 | Wakeman | |
| 4,828,110 | A | | 5/1989 | Lems | |
| 4,941,572 | A | | 7/1990 | Harris | |
| 5,020,669 | A | * | 6/1991 | Nakagoshi | 206/497 |
| 5,228,564 | A | * | 7/1993 | Randeria | 206/497 |
| 5,363,981 | A | * | 11/1994 | Giblin et al. | 229/933 |
| 5,452,848 | A | | 9/1995 | Mur Gimeno | |
| 5,472,092 | A | | 12/1995 | Evert | |
| 5,551,563 | A | | 9/1996 | Allen | |
| 5,579,917 | A | * | 12/1996 | Lofgren et al. | 206/583 |
| 5,632,439 | A | * | 5/1997 | Yucknut et al. | 206/497 |
| 5,676,245 | A | * | 10/1997 | Jones | 206/497 |
| 5,741,535 | A | * | 4/1998 | Cope et al. | 206/497 |
| 5,950,915 | A | | 9/1999 | Moen | |
| 5,992,630 | A | | 11/1999 | Brown et al. | |
| 6,328,202 | B1 | | 12/2001 | Giblin | |

* cited by examiner

*Primary Examiner*—Luan K. Bui
(74) *Attorney, Agent, or Firm*—Gerard J. McGowan, Jr.

(57) ABSTRACT

A new way of shipping cartons and other packages so as to minimize the cost and the resource used. The invention is directed in the first embodiment to a liner, particularly for use in combination with shrink wrap packaging, which includes corners for compressive strength and yet panels having deceased height intermediate such corners. The decreased height panels result in conversation of the resource used to make the liner. In a preferred embodiment, the liners are nestable so that they fit closely one on top of each other in the manufacturing process, therefore conserving space. Moreover, nestability of the liner blanks helps promote conservation of resource particularly when the liner blanks are cut from the same fiberboard blank.

6 Claims, 2 Drawing Sheets

LINER

BACKGROUND OF THE INVENTION

There is substantial pressure to reduce costs and conserve resources in the manufacture of products. This is particularly true of the resource devoted to packaging and shipping of products such as detergent cartons. Often such products will be shipped in a shipping case made of corrugated fiberboard.

Brown et al., U.S. Pat. No. 5,992,630 discloses a packaged product which includes a plurality of cartons, a corrugated board of paperboard carrier wall disposed along a portion of the periphery, and shrink wrapping. The Brown et al. invention does not require a full shipping case, but utilizes corrugated board or paperboard as the carrier wall for the multipack.

Fales, U.S. Pat. No. 4,306,653 discloses a packaging container for protection of fragile articles during shipping and storage which includes an outer carton and plurality of inner packing support panels attached to the contained article by a heat shrinkable film.

Harris, U.S. Pat. No. 4,941,572 discloses a package for shipping and storing articles, such as cut flower arrangements. A plastic film vented shell is disposed about the flowers and connected to a container in shrink wrap relation. The package includes a U-shaped insert.

Anderson, U.S. Pat. No. 3,804,235 discloses a package comprising an article having heat shrinkable material wrapped therearound. A thickening ridge defines a reinforcement which prevents tearing. A plurality of articles may be disposed in juxtaposed position within the package.

Wakeman, U.S. Pat. No. 4,738,371 discloses a reusable, rollable wrap for securing items stacked on a rectangular pallet. The wrap includes a flexible sheet and a plurality of parallel stiff elongate corner support members which are secured to the sheet at spaced apart intervals.

Goettsch et al., U.S. Pat. No. 2,762,550 discloses a reinforcement for a container. In FIG. 2, a blank is shown having a pair of interlocking, complementary reinforcing members formed therefrom.

Other patents involving shrink wrap packaging or other related forms of packaging include Richardson, U.S. Pat. No. 3,918,584, Shelton, U.S. Pat. No. 4,177,895, Clarkson, U.S. Pat. No. 4,730,730, Lems, U.S. Pat. No. 4,828,110, Roth, U.S. Pat. No. 4,119,202, Macomber, U.S. Pat. No. 3,571,815, Heays, U.S. Pat. No. 4,030,600, Lawson et al., U.S. Pat. No. 3,995,736, Allen, U.S. Pat. No. 5,551,563, Moen, U.S. Pat. No. 5,950,915, MurGimeno, U.S. Pat. No. 5,452,848.

There is still a need for an effective way to ship products utilizing minimal resource.

SUMMARY OF THE INVENTION

The invention is directed to the discovery of a new way of shipping cartons and other packages so as to minimize the cost and the resource used. The invention is directed in the first embodiment to a liner, particularly for use in combination with shrink wrap packaging, which includes corners for compressive strength and yet panels having deceased height intermediate such corners. The decreased height panels result in conversation of the resource used to make the liner. In a preferred embodiment, the liners are nestable so that they fit closely one on top of each other in the manufacturing process, therefore conserving space. Moreover, nestability of the liner blanks helps promote conservation of resource particularly when the liner blanks are cut from the same fiberboard blank.

For a more complete understanding of the above and other features and advantages of the invention, reference should be made to the following description of the preferred embodiments.

DETAILED DESCRIPTION OF THE INVENTION

Figure 1:
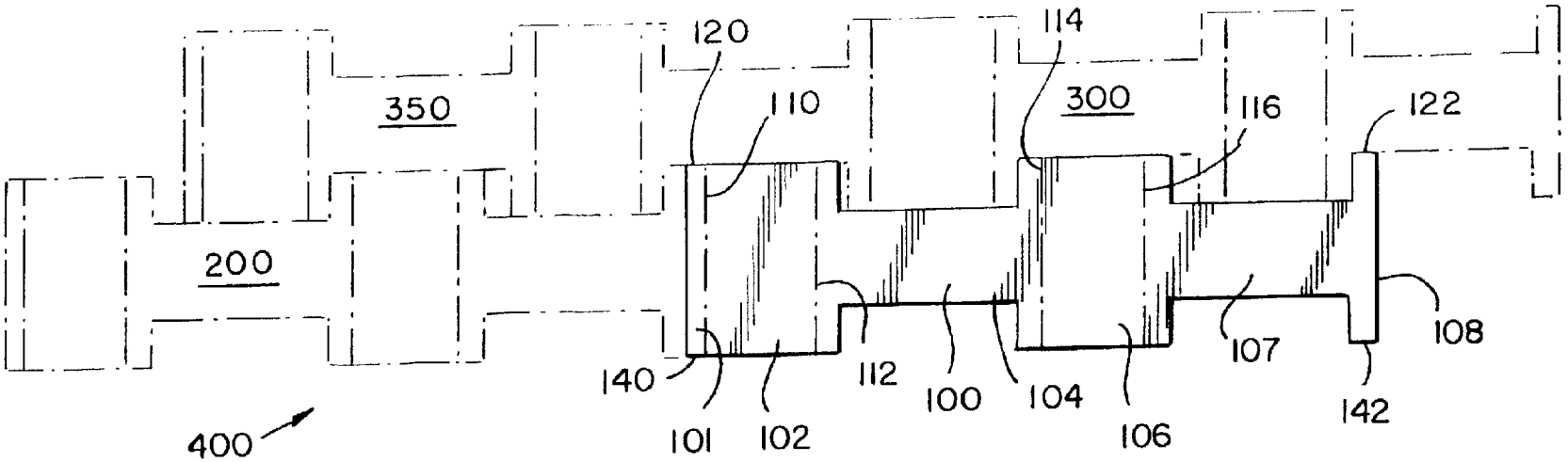
FIG. 1 is a top plan view of a blank shown in bold suitable for forming the liner of the invention, nested with other blanks.

Referring to FIG. 1, liner 100 is formed of corrugated fiberboard or corrugated plastic board It comprises first glue flap 101, first side panel 102, rear panel 104, second side panel 106, front panel 107 and second glue flap 108. Separating glue flap 101 form side panel 102 is transverse score or fold line 110. Separating side panel 102 from rear panel 104 is second fold line 112. Separating rear panel 104 from side panel 106 is third fold line 114 and separating side panel 106 from front panel 107 is fourth fold line 116.

The heights of panels 100, 107 are reduced medial to the fold lines which define their ends. At the fold lines, the height of the liner is preferably roughly equivalent to or slightly greater than the height of the package around which the liner is wrapped. This will provide full compression strength, particularly at the corners of the liner. At the tops and bottoms of the liner at the fold lines 110 and 114 and 116, the inner extends at its top and bottom for a short distance in a direction parallel to the longitudinal axis of the liner and roughly parallel and adjacent to the tops and bottoms of the packages which the liner is meant to contain. For panels 104 and 107, after the short section which is parallel to the longitudinal axis, the upper and lower sides of the liner extend perpendicularly toward the middle of the liner for a short distance after which the upper and lower ends of the liner again are disposed parallel to the longitudinal axis of the liner. In this way, the liner provides for good compressive strength at the corners and yet spares resource by not including the full height intermediate the fold lines.

At the glue flaps 101, 108, fold lines 110, 116 also exist. The glue flaps will generally be full height. That is, their height will generally correspond to the height of the package which is being contained. Upper ends 120, 122, extend parallel to the longitudinal axis of the liner. Bottom ends 140, 142 of glue flaps 101, 108 are generally disposed parallel to the longitudinal axis of the liner and adjacent and parallel to the lower ends of the packages which the liner is meant to contain.

As seen in FIG. 1, liners 100, 200, 300 and 350 can be manufactured in a nesting arrangement and can be prepared by making cuts in a single fiberboard sheet. Thus, the nest 400 of FIG. 2 reflects not only a desirable way to transport the liners, but shows the positions of the liners right after they have been cut from the fiberboard. The nest of FIG. 2 is created by imposing the fold lines and making the cuts which define the liner edges.

The fold lines may be scorelines or other lies which weaken the fiberboard and promote the folding of the material.

Figure 2:
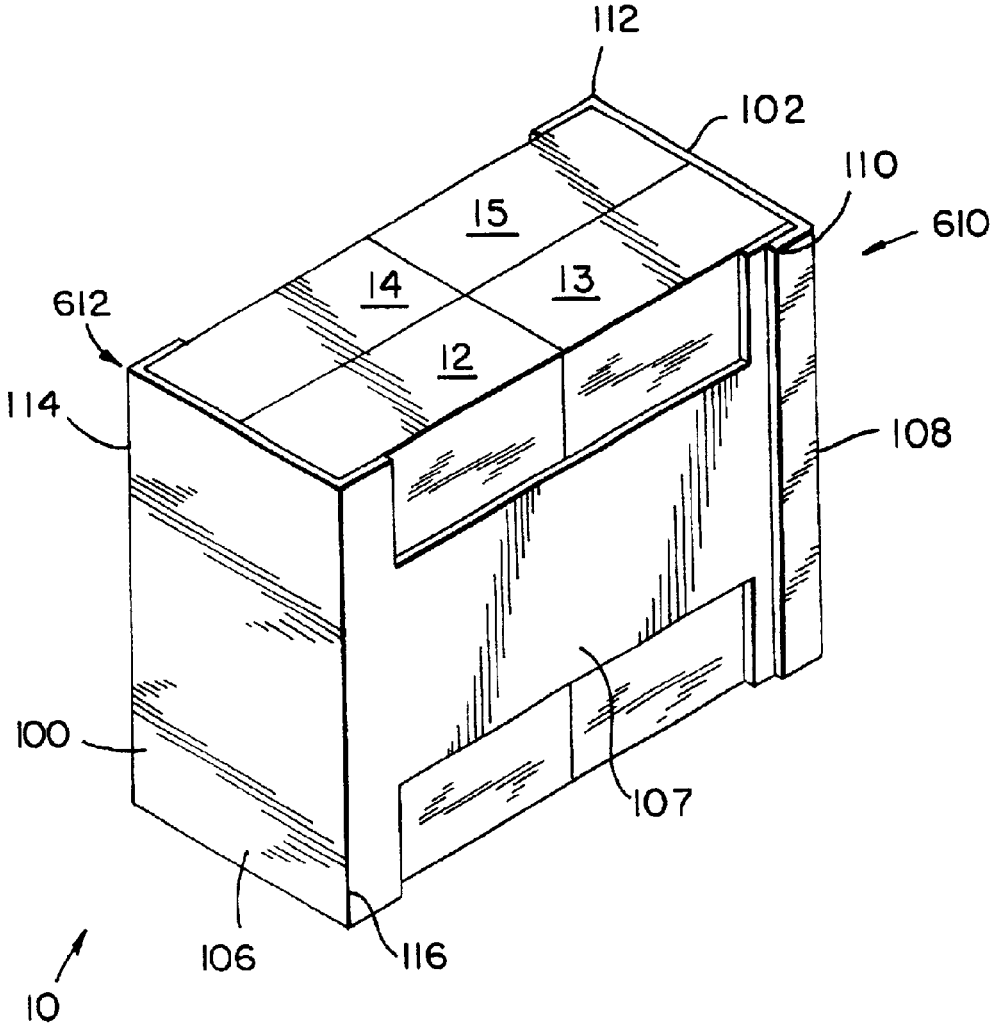
FIG. 2 is a perspective view of a unit of four juxtaposed packages which has been wrapped in accordance with the invention.

FIG. 2 shows a package utilizing the liner of the invention.

In FIG. 2, unit 10 wherein cartons 12, 13, 14 and 15 are juxtaposed side by side has liner 100 wrapped therearound and may be enclosed by (optional) clear shrink wrap film 16. Film 16 is made of a low density polyethylene or LDPE/HDPE blend. If desired, film 16 may instead be opaque. If desired, the shrink wrap can be formed by more than one sheet, e.g. one film from the top of the unit and another from the bottom and then heat sealing the sheets together. The thickness of sheet 16 is preferably from 0.001" to 0.005".

Heat sealing of the two films from opposite directions may result in creation on each of the opposite ends of the unit of a "bullseye" opening which may be used as a gripping opening (not shown).

If so desired, the shrink wrap 16 may be provided with perforations to assist in opening the package.

The unified liner is made by adhering glue flap 108 to glue flap 101. When liner 100 is wrapped around the unit 10 of juxtaposed cartons 12, 14, 15 and 16, fold line 112 folds about corner 610 and fold line 114 fold about corner 612. The presence of the full height liner at these and other corners yields good compressive strength for the overall package.

The glue flaps can be adhered with any known adhesive such as chemical adhesive or hot melt.

As seen in FIG. 1, full height portions of liners 100, 200, 300 nest within shortened height portions of adjacent liners. This is advantageous for shipping and for manufacture. In manufacture, this means less wasted resource in preparing the liner.

Preferably, the packages of the unit are cartons and more preferably, the cartons are made of corrugated board. This enhances the compressive strength, notwithstanding the absence of a shipping case or a sleeve of paperboard or corrugated material within the any bundle. The liner can be used to transport the cartons without any shrink wrapping if desired, if tier sheets are used. As an example, the liner may be used to wrap around four cartons and numerous, (e.g., 12) of these lined units can be used as a single tier on a pallet. In general, if the unit is not to be shrink wrapped, a tier sheet will be used to separate the different multiple unit tiers on the pallet. A tier sheet may, for example, be made of corrugated fiberboard. Where tier sheets are not to be used, then the individual units may be shrink wrapped as with the low density polyethylene film mentioned above.

Where cartons are used as a package, they may be made from paperboard or, more preferably as indicated above, corrugated fiberboard. Any shrink wrapping films may be applied by conventional means such as heat sealing the leading edge (in the cross direction), pushing the cartons against the sealed edge with the films top and bottom, then sealing the trailing edge (CD), and then finally passing the bundle through heat tunnel equipment to form a tight heat-sealed bundle.

Preferably the liner of the invention is not adhered to the cartons around which it is wrapped. Also, as mentioned above, the lined unit may be non-shrink wrapped.

It should be understood of course that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A combination liner and shrink wrap packaging comprising a liner wrapped around a plurality of packages and further comprising shrink wrapping around said combination of liner and packages, said liner including at least three panels separated by fold lines at corners, the height of said liner at said corners being the same or different, the height of at least one of said panels at a point intermediate said corners being less than 90% of the height at any of said corners, said liner corners being disposed adjacent and receiving corners of said packages.

2. The combination liner and shrink wrap packaging of claim 1 wherein the height of the liner is less than 90% of the height of any of said corners for at least 60% of the rectilinear distance between two of said corners.

3. The combination liner and shrink wrap packaging of claim 1 wherein said liner includes at least four transverse fold lines forming said corners.

4. The combination liner and packaging of claim 1, wherein said panels include a top free edge and a bottom free edge.

5. A combination liner and package comprising a liner wrapped around a plurality of cartons, said liner including at least three panels separated by fold lines at corners, the height of said liner at said corners being the same or different, the height of at least one at said panels at a point intermediate said corners being less than 90% of the height at any of said corners said liner corners being disposed adjacent and receiving corners of said cartons.

6. The combination liner and package of claim 5, wherein said panels include a top free edge and a bottom free edge.

* * * * *